US006676253B2

(12) United States Patent
Hsu et al.

(10) Patent No.: US 6,676,253 B2
(45) Date of Patent: Jan. 13, 2004

(54) AIR PRESSURE REGULATING DEVICE FOR INK CARTRIDGES

(75) Inventors: Chi-Chung Hsu, Hsinchu Hsien (TW); Wen-Chung Chen, Hsinchu Hsien (TW)

(73) Assignee: NanoDynamics Inc., Hsinchu Hsien (TW)

( * ) Notice: Subject to any disclaimer, the term of this patent is extended or adjusted under 35 U.S.C. 154(b) by 0 days.

(21) Appl. No.: 10/195,418

(22) Filed: Jul. 16, 2002

(65) Prior Publication Data

US 2003/0020793 A1 Jan. 30, 2003

(30) Foreign Application Priority Data

Jul. 27, 2001 (TW) ..... 90118438 A

(51) Int. Cl.[7] ..... B41J 2/175
(52) U.S. Cl. ..... 347/86; 347/87
(58) Field of Search ..... 347/17, 84–87; 454/270, 301, 302, 254

(56) References Cited

U.S. PATENT DOCUMENTS 4,992,802 A 2/1991 Dion et al. ..... 347/87
5,040,002 A 8/1991 Pollacek et al. ..... 347/87
6,273,562 B1 * 8/2001 Deshmukh ..... 347/86
6,293,666 B1 * 9/2001 Mou et al. ..... 347/87

* cited by examiner

*Primary Examiner*—Juanita Stephens
(74) *Attorney, Agent, or Firm*—Birch, Stewart, Kolasch & Birch, LLP

(57) ABSTRACT

An air pressure regulating device for ink cartridges that is not affected or interfered with by magnetic fields. In accordance with the invention a ventilating vent is settled inside the ink cartridge so that the inside region of the ink cartridge is open to the ambient air and at the same time this ventilating vent is also directed to a fixed seat. In the fixed seat a gas vent is settled to direct to the ink cartridge. On the outside region of the gas vent settled in the fixed seat a layer of elastic gastight material is covered such that it can be utilized to seal the gas vent to keep the ink cartridge sealed under ordinary conditions. When the pressure difference between the outside and inside regions of the ink cartridge reaches a critical value, the layer of the elastic gastight material is slightly pushed away so that a small quantity of air can flow into the ink cartridge to return the pressure to within a normal operating range.

31 Claims, 8 Drawing Sheets

AIR PRESSURE REGULATING DEVICE FOR INK CARTRIDGES

BACKGROUND OF THE INVENTION

1. Field of the Invention

The invention relates to an air pressure regulating device for ink cartridges that can be applied to ink cartridges of ink jet printers, and particularly relates to an air pressure regulating device that uses elastic gastight materials to seal gas vents so that the negative pressure inside the ink cartridge can be maintained within an operating range in which the ink cartridge can operate normally and ink leakage can be prevented from the ink pens.

2. Related Art

Ink jet printers are already one of the most reliable and effective printers nowadays. Conventionally, an ink jet printer possesses a ink pen, which can move above the printed media repeatedly and eject ink droplets from the ink pen on the printed media. The printhead is controlled by a control system to move to a required position and eject ink droplets from the ink pen on the printed media via the printhead so that the ejected ink droplets form the required images or data. These kinds of printers usually possess an ink pen constructed mainly of an ink cartridge functioning as an ink supply source and a printhead.

Two commonly utilized systems that can be applied to command the printhead to eject ink droplets by a sequence of control orders are the thermal bubble system and the piezoelectric system. The printheads for these two systems possess usually more than one orifice and each of the orifices is connected to the associated ink chamber. When the systems are in use, the ink is guided from the ink cartridge into the ink chambers of the printhead and then is ejected through the orifices from the ink chambers on the printed media. For the printhead of the thermal bubble system the ink inside the ink chambers is reheated to vaporize in a very short time by a thin-film resistor and then the ink droplets can be ejected through the orifices of the printhead on the printed media by the outward expansive forces induced by the vaporization of the ink. For the printhead of the piezoelectric system some piezoelectric elements are settled so that a specific quantity of ink inside the ink chambers is ejected from the ink chambers through the orifices of the printhead on the printed media by the pressure waves induced by the actions of the piezoelectric elements actuated by a sequence of control orders.

Although the two designs of the above-described systems are reliable and effective, the leakage of ink still occurs and until now there is no better mechanism for preventing ink from drooping from the orifices when the printhead is in use. If the ink droops from the orifices, then the locations of the ejected ink droplets are not precise and thus the printing quality is negatively influenced. In order to overcome this problem a slight negative pressure must be maintained inside the ink cartridge such that the ink inside the ink cartridge does not droop from the orifices when the printhead is temporarily or continuously not in use.

In the following descriptions the negative pressure is the pressure difference between the ink cartridge and the ambient air under the assumption that the negative pressure inside the ink cartridge is less than that in the ambient air. Enough negative pressure must be maintained inside the ink cartridge so that it can prevent the ink from the orifices of the printhead to droop. But if the negative pressure is too high, then it will counteract the driving forces used to eject the ink droplets from the printhead. The possible influence of this phenomena is that the scales of the ejected ink droplets could not be steadily maintained or could gradually decrease, and the printing quality could become worse.

In order to make the systems operate normally, the negative pressure should be maintained within an operating range, that is, the negative pressure must be high enough to prevent the ink from drooping from the printhead while also low enough so as not to hinder the ejection of ink.

There are already many different technologies that can be utilized to cover the above-discussed requirements for different product specifications. For example, John H. Dion et al., have proposed the invention titled "Method and apparatus for extending the environmental operating rage of an ink jet print cartridge" (U.S. Pat. No. 4,992,802), wherein the negative pressure is controlled by two negative pressure control mechanisms. The first negative pressure control mechanism is utilized to control the flow rates for air pressure regulating or ink-refilling while the second negative pressure control mechanism is applied to control the volume occupied by the ink inside the ink cartridge. By these two negative pressure control mechanisms the negative pressure inside the ink cartridge can be maintained within a normal operating range.

Though with the invention proposed by John. H. Dion the negative pressure inside the ink cartridge can be reasonably controlled, the structures are rather complicated and the volume of the ink cartridge in which ink is stored cannot be optimally utilized. Therefore James E. Pollacek has proposed other design titled "Regulator for ink-jet pens" (U.S. Pat. No. 5,040,002) having a simpler structure to the one from John. H. Dion. In this invention a ventilating vent is settled in the ink cartridge and above the ventilating vent a metallic valve and valve seat are also set. This metallic valve can be closed by magnetic forces until the negative pressure inside the ink cartridge is large enough to let the negative pressure of the ambient air reopen the valve so that the ambient air can refill the ink cartridge. After that the magnetic force once again closes the metallic vale so that the ink cartridge is sealed to maintain its internal negative pressure. By the above described mechanism the negative pressure inside the ink cartridge can be kept within a specific operating range.

Although this inventive design for ink cartridges in which the metallic valve is controlled by magnetic force to let the ambient air refill the ink cartridge has a simpler structure, the metallic valve and valve seat are affected strongly by magnetic forces to change their functions so that the specific operating range for the pressure cannot be preciously controlled and consequently the printing quality will seriously decrease if the products with this design are placed near strong magnetic fields.

SUMMARY OF THE INVENTION

In light of the invention proposed by James E. Pollacek, the object of the present invention is to design an ink cartridge that is simpler in structure and for which the associated metallic valve and valve seat will not be affected by magnetic forces. In accordance with the design of the invention a ventilating vent is settled in the ink cartridge such that the ink cartridge can be connected through this ventilating vent to the ambient air, and this ventilating vent is also directed to a fixed seat. On the fixed seat a gas vent is settled and directed to the ink cartridge. On the outside region of the gas vent a layer of elastic gastight material is covered so that it can be used to seal the gas vent to keep the ink cartridge sealed under ordinary conditions. When the ink cartridge is in use, the free liquid surface level of the ink inside the ink cartridge gradually decreases during the printing operations, while the volume occupied by the air inside the ink cartridge gradually increases. This is because the ambient air cannot refill the ink cartridge as the gas vent is sealed by the layer of the elastic gastight material. From the Boyle and Charles' law it is understood that the gas pressure decreases when the gas volume increases if the gas pressure and temperature do not vary. Therefore the pressure inside the ink cartridge steadily increases during continuous printing operations. When the pressure difference between the inside and outside regions of the ink cartridge reaches a critical value, the layer of the elastic gastight material utilized to seal the gas vent is pressed away from the gas vent by the atmospheric pressure so that a small quantity of ambient air can flow into the ink cartridge to return the negative pressure inside the ink cartridge to within a normal operating range. Because the pressure difference between the outside and inside regions of the ink cartridge reduces once more and the force induced by the elasticity of the gastight material is larger than that induced by the atmospheric pressure, the gas vent can once again be sealed such that the negative pressure inside the ink cartridge can be maintained.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
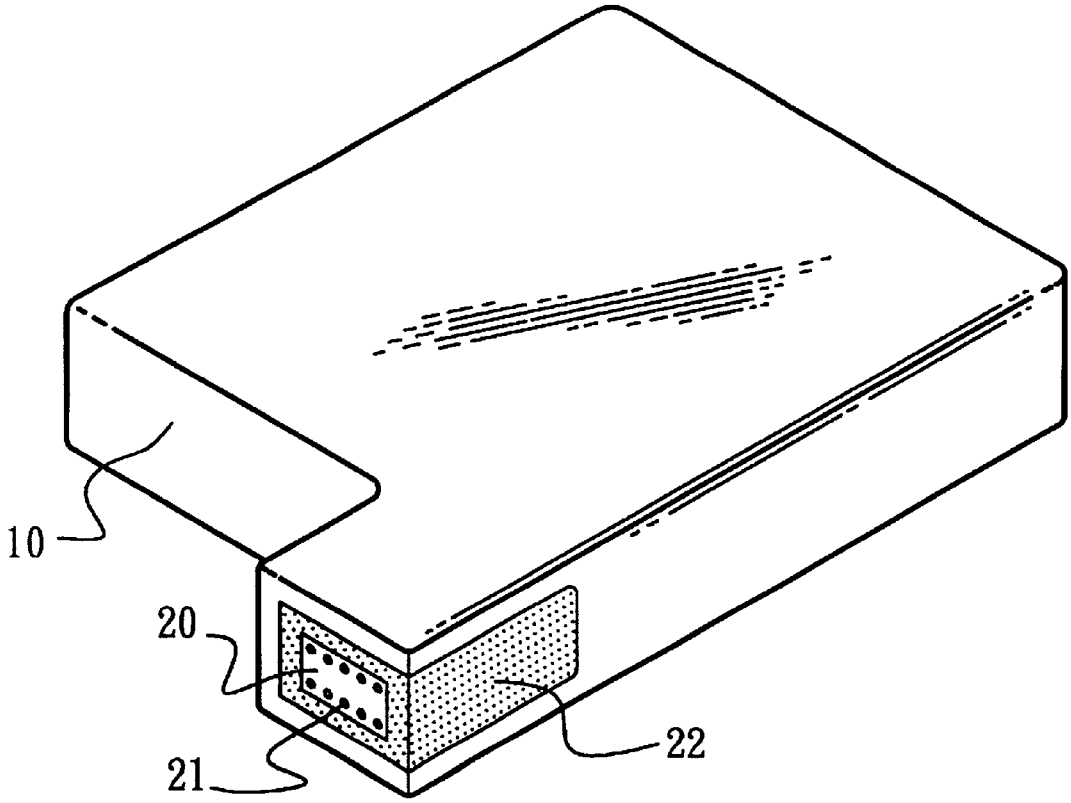
FIG. 1 illustrates a three-dimensional perspective of the invention and is only for schematic purposes and is not drawn to scale.
Figure 2:
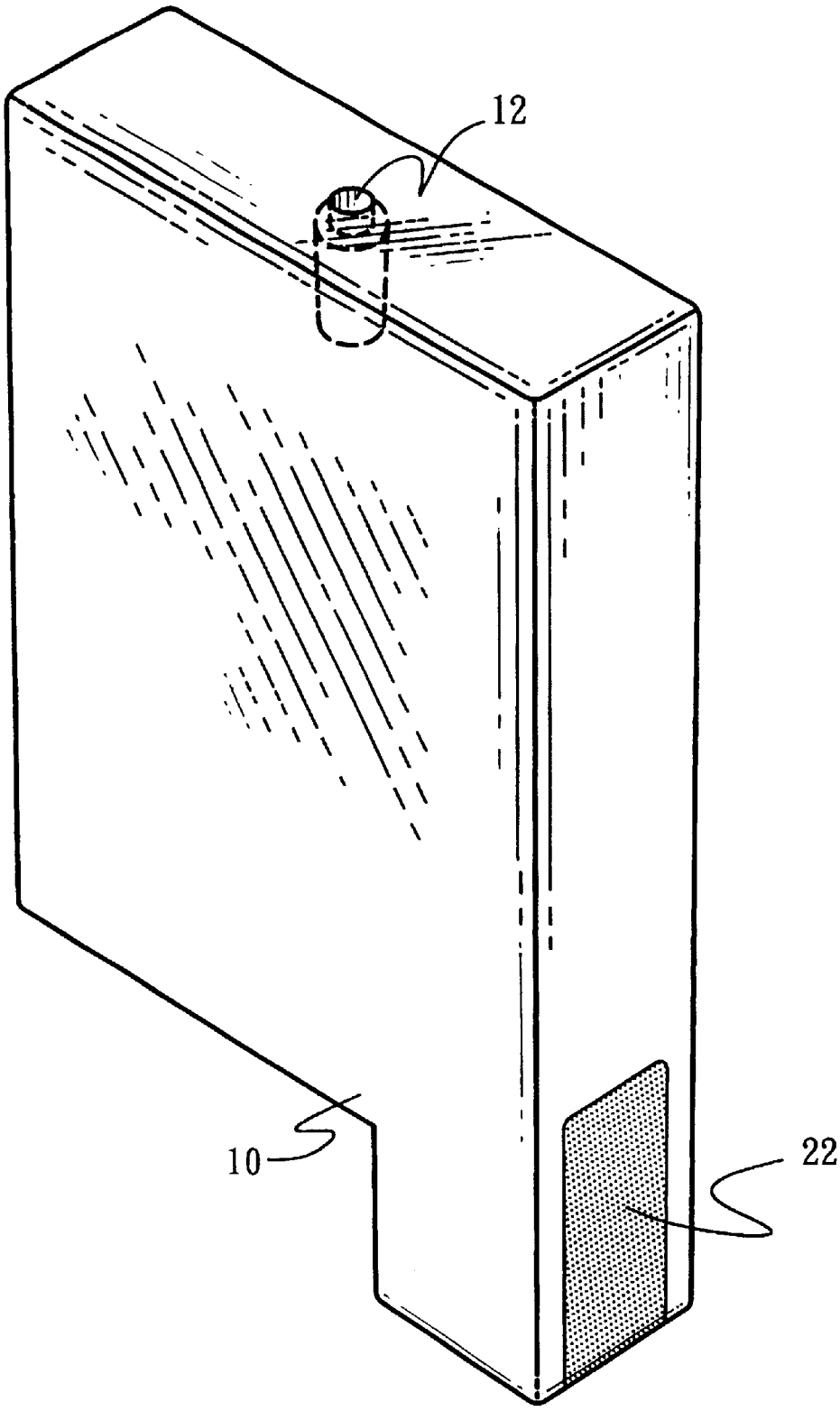
FIG. 2 illustrates a three-dimensional perspective of the invention from another point of view and is only for schematic purposes and is not drawn to scale.

As shown in FIGS. 1 and 2, the ink pen proposed by the invention comprises an ink cartridge 10 and a printhead 20. The printhead 20 has a plurality of orifices 21. They can be controlled independently to eject ink droplets on the printed media by inputting sequence control signals received by a flexible printed circuit 22.

Either the thermal bubble system or the piezoelectric system can be applied to the printhead 20 of the invention. No matter which system is chosen, several orifices are settled with the printhead 20 of the selected system and each of the orifices 21 is connected with its associated ink chamber. The ink 30 is guided from the ink cartridge 10 into the ink chambers (not shown in the figures) of the printhead 20 and is then ejected through the orifices 21 on the printed media. If the printhead 20 for the thermal bubble system is utilized, then a thin-film resistor (not shown in the figures) is settled inside the printhead such that it can be used to heat the ink 30 inside the ink chambers. Ink 30 can then be ejected out of the printhead 20 through the orifices by the force induced by the vaporization of the ink. If the printhead for the piezoelectric system is applied, then some piezoelectric elements should be settled with the printhead 20 so that they can be controlled by the control signals received by the flexible printed circuit 22 to induce pressure waves to eject a specific quantity of ink 30 from the ink chambers of the printhead 20 via the orifices 21.

The First Embodiment of the Invention

Figure 3:
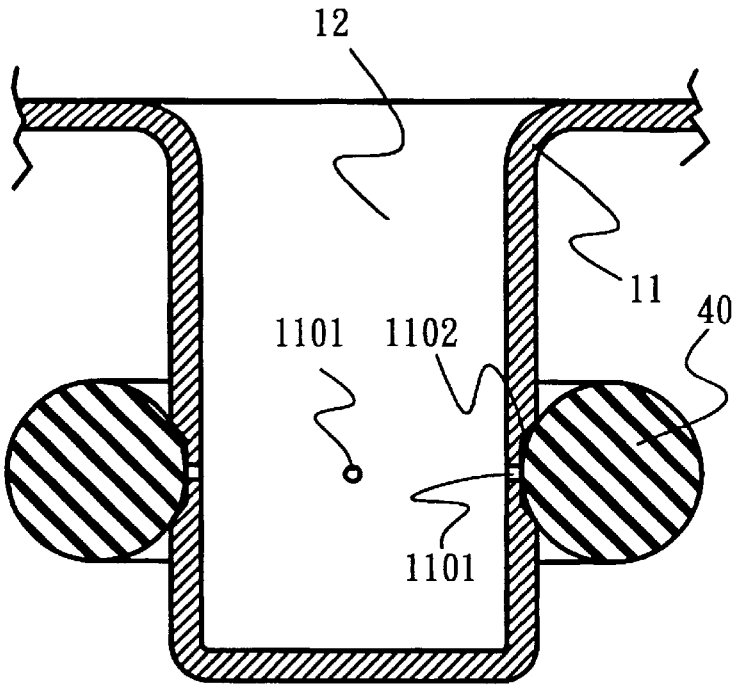
FIG. 3 illustrates the first embodiment of the invention.

FIG. 3 shows the first embodiment of the invention, wherein a ventilating vent 12, a fixed seat 11, and an elastic gastight O-ring 40 are established with the ink cartridge 10. The inside region of the fixed seat 11 is connected with the ventilating vent 12, while in the outside region of the fixed seat an annular trench having a trapezial shape 1102 is settled. On the bottom of this annular trench a gas vent 1101 is settled and is connected to the ventilating vent 12 through the inside region of the fixed seat 11. The above-described elastic gastight O-ring 40 can be settled on the annular trench having a trapezial shape 1102 established in the outside region of the fixed seat 11 to seal the gas vent 1101.

When the pressure difference between the inside and outside regions of the ink cartridge reaches a critical value, the force exerted on the gas vent 1101 induced by the atmospheric negative pressure is in equilibrium with that induced by the elasticity of the gastight O-ring 40. But if the pressure difference continues to increase, then the force exerted on the gas vent 1101 that is induced by the atmospheric pressure will be greater than that induced by the elasticity of the gastight O-ring 40. Consequently the elastic gastight O-ring is pushed away from the gas vent so that a small quantity of air flows into the ink cartridge 10 to make the negative pressure inside the ink cartridge within operating range.

For the printheads of the thermal bubble or the piezoelectric systems the operating range for the negative pressure is conventionally between −2.5 and −10 $cmH_2O$. It is desirable to set the critical value (the pressure difference between the outside and inside regions of the ink cartridge 10) to between 9 and 10 $cmH_2O$.

The Second Embodiment of the Invention

Figure 4:
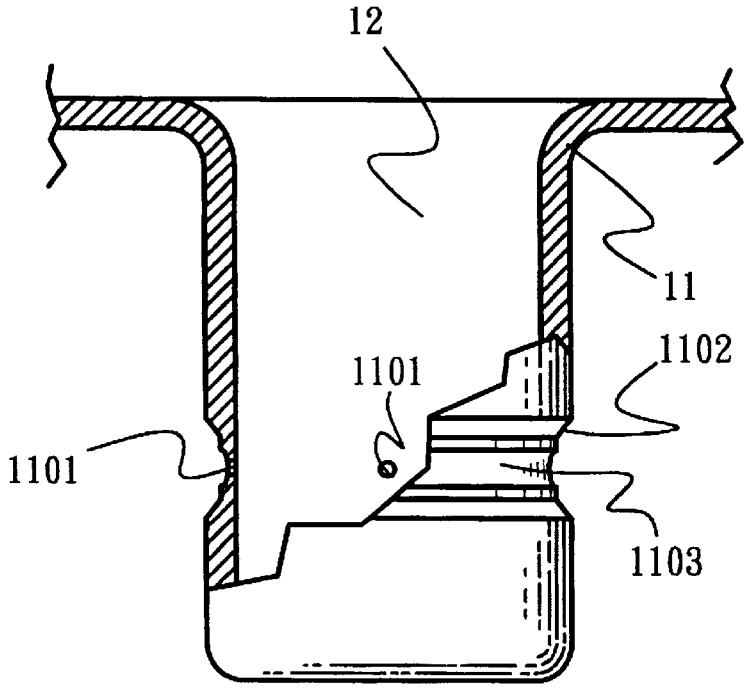
FIG. 4 illustrates the second embodiment of the invention.

As shown in FIG. 4, in order to increase the contact areas between the atmospheric pressure and the elastic gastight O-ring 40, a second annular trench 1103 can be further settled on the bottom of the annular trench having a trapezial shape 1102 of the fixed seat 11 of the first embodiment. The ambient air flows into the fixed seat 11 through the ventilating vent 12, and then continuously flows into the second annular trench 1103 via the gas vent 1101. The second annular trench 1103 is completely sealed by the elastic gastight O-ring 40 until the pressure difference between the outside and inside regions of the ink cartridge 10 reaches a critical value. At this time the force induced by the atmospheric pressure exerted on the elastic gastight O-ring 40 is in equilibrium with that induced by the elasticity of the gastight O-ring 40. If the pressure difference continuously increases, then the force induced by the atmospheric pressure exerted on the second annular trench 1103 will be greater than that induced by the elasticity of the gastight O-ring 40 exerted on the second annular trench 1103. Thus the elastic gastight O-ring 40 can be slightly pushed away and a small quantity of air flows into the ink cartridge 10, and the negative pressure inside the ink cartridge is returned to within operating range, for example, between −2.5 and −10 $cmH_2O$.

The Third Embodiment of the Invention

Figure 5:
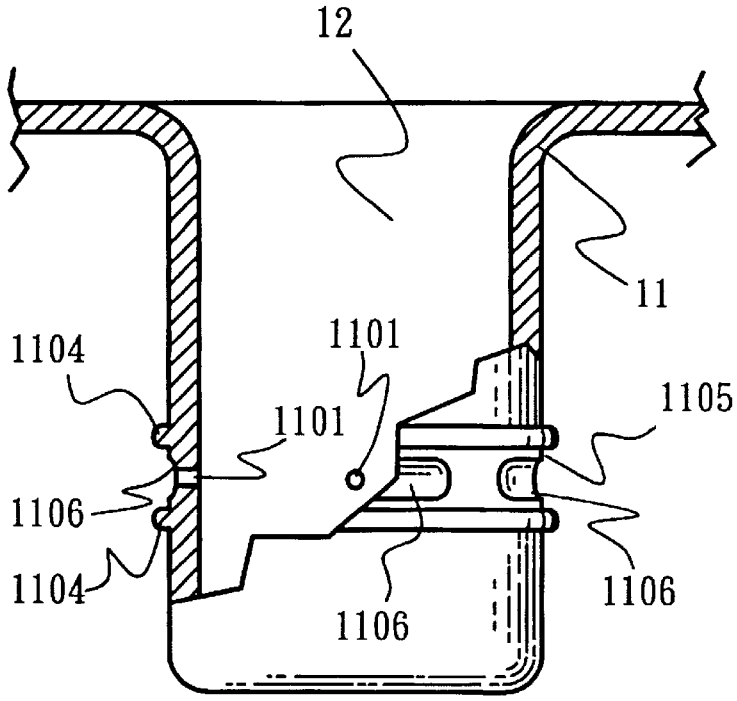
FIG. 5 illustrates the third embodiment of the invention.

As shown in FIG. 5, a pair of convex rings 1104 can be settled on the surface of the fixed seat 11 so that an annular trench 1105 is formed between these two convex O-rings 1104. The annular trench 1105 can be utilized to replace the annular trench having a trapezial shape 1102 used in the first embodiment and therefore it can be applied to fix the elastic gastight O-ring 40.

In order to maintain the strength of the fixed seat 11, the annular trench 1103 used in the first embodiment can be replaced by piecewise concave trenchs 1106. This replacement can also increase the contact areas between the atmospheric pressure and the elastic gastight O-ring 40. The working principles are the same as those described in the first embodiment and will not be discussed here.

The Fourth Embodiment of the Invention

Figure 6:
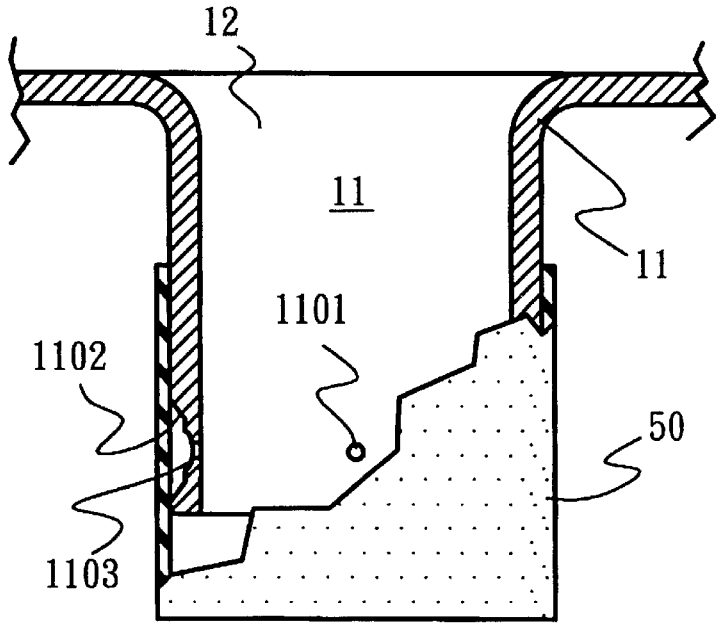
FIG. 6 illustrates the fourth embodiment of the invention.

No matter which fixed seat 11 from the above-described embodiments of the invention is selected, an elastic gastight sleeve 50 can be settled to cover the fixed seat 11 so that the gastight requirements are met. As shown in FIG. 6, an annular trench having a trapezial shape 1102 is established on the surface of the fixed seat 11 and is enclosed by the elastic gastight sleeve 50 such that the air inside the annular trench having a trapezial shape is sealed and cannot flow into the ink cartridge 10. The elastic gastight sleeve may be an elastic rubber or plastic sleeve. The upper ends of the elastic gastight sleeve 50 and the fixed seat 11 are formed to be slightly smaller or larger, respectively, so that they can hold tight to each other through their upper ends to prevent the elastic gastight sleeve 50 from sliding from the fixed seat 11. The air can only be allowed to flow into the ink cartridge 10 through the contact areas between the elastic gastight sleeve 50 and the bottom of the fixed seat 11.

When the pressure difference between the inside and outside regions of the ink cartridge reaches a critical value of the operating range for the negative pressure inside the ink cartridge 10, the force induced by the atmospheric pressure exerted on the elastic gastight sleeve 50 is in equilibrium with that induced by the elasticity of the elastic gastight sleeve 50. If the pressure difference continuously increases, then the force induced by the atmospheric pressure exerted on the elastic gastight sleeve 50 is greater then that induced by the elasticity of the elastic gastight sleeve 50. Therefore the elastic gastight sleeve 50 is slightly pushed away such that a small quantity of air can flow into the ink cartridge 10 to reduce and return the pressure to within operating range.

The Fifth Embodiment of the Invention

Figure 7:
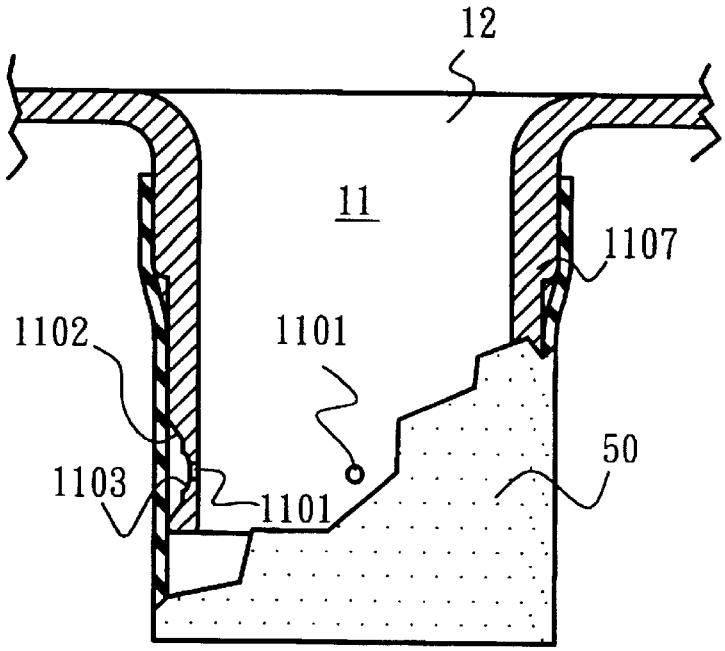
FIG. 7 illustrates the fifth embodiment of the invention.

The fixed seat 11 can also be formed with other shapes, as shown in FIG. 7. Based on the design of the invention a flange 1107 can be settled on the bottom of the fixed seat 11, so that when the elastic gastight sleeve 50 is settled to enclose the fixed seat 11, the air can only flow into the ink cartridge 10 via the bottom of the elastic gastight sleeve 50. The flange 1107 holds the upper region of the elastic gastight sleeve 50 completely tight to prevent it from sliding.

The Sixth Embodiment of the Invention

Figure 8:
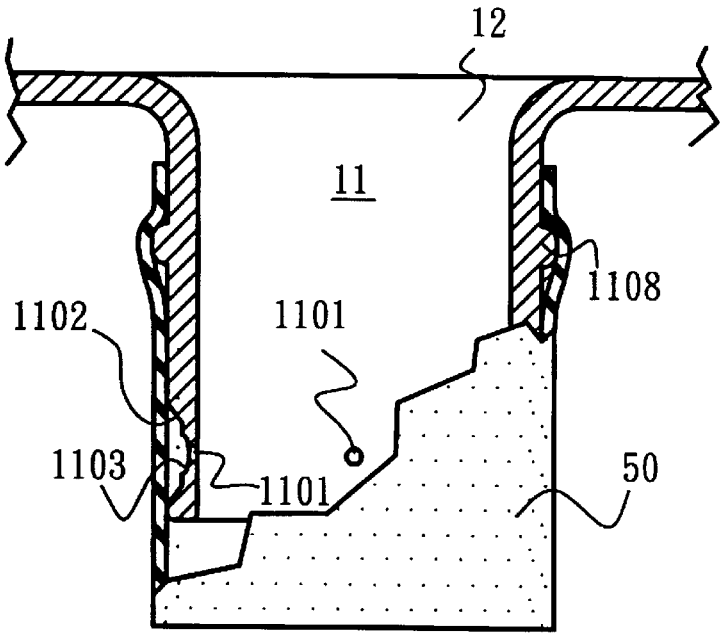
FIG. 8 illustrates the sixth embodiment of the invention.

Another possible shape of the fixed seat 11 is shown in FIG. 8, wherein a convex ring 1108 is settled with the fixed seat 11 so that the air can only flow into the ink cartridge 10 through the bottom of the elastic gastight sleeve 50 when the elastic gastight sleeve 50 is settled to enclose the fixed seat. Thus the elastic gastight sleeve does not easily slide via the action of the convex ring 1108.

The First Application Example of the Fourth Embodiment

Figure 9:
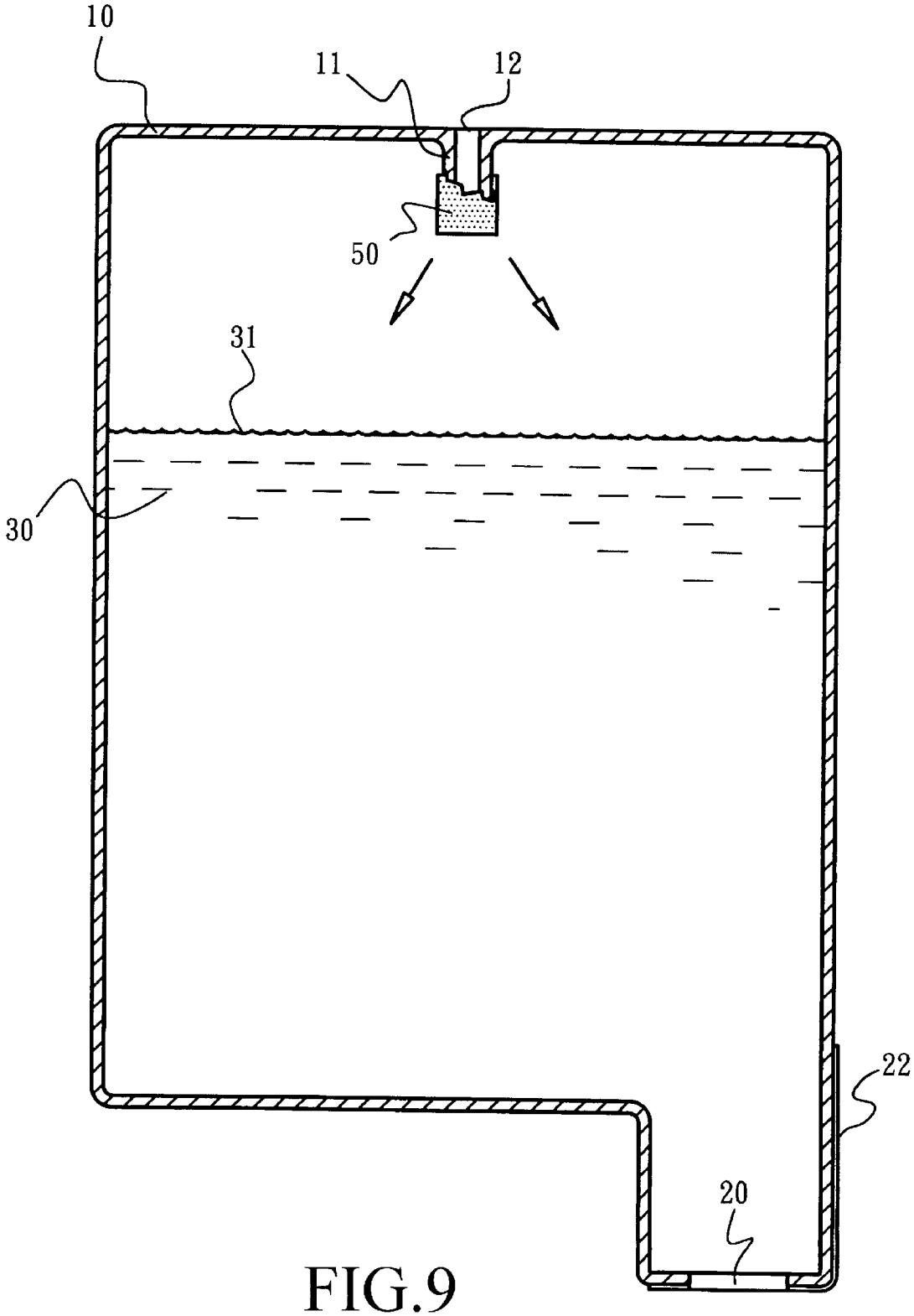
FIG. 9 illustrates the first application example of the fourth embodiment of the invention.

Refer to FIG. 9 for this application example, wherein air can flow directly into the ink cartridge 10 and be in contact with the ink 30.

The Second Application Example of the Fourth Embodiment

Figure 10:
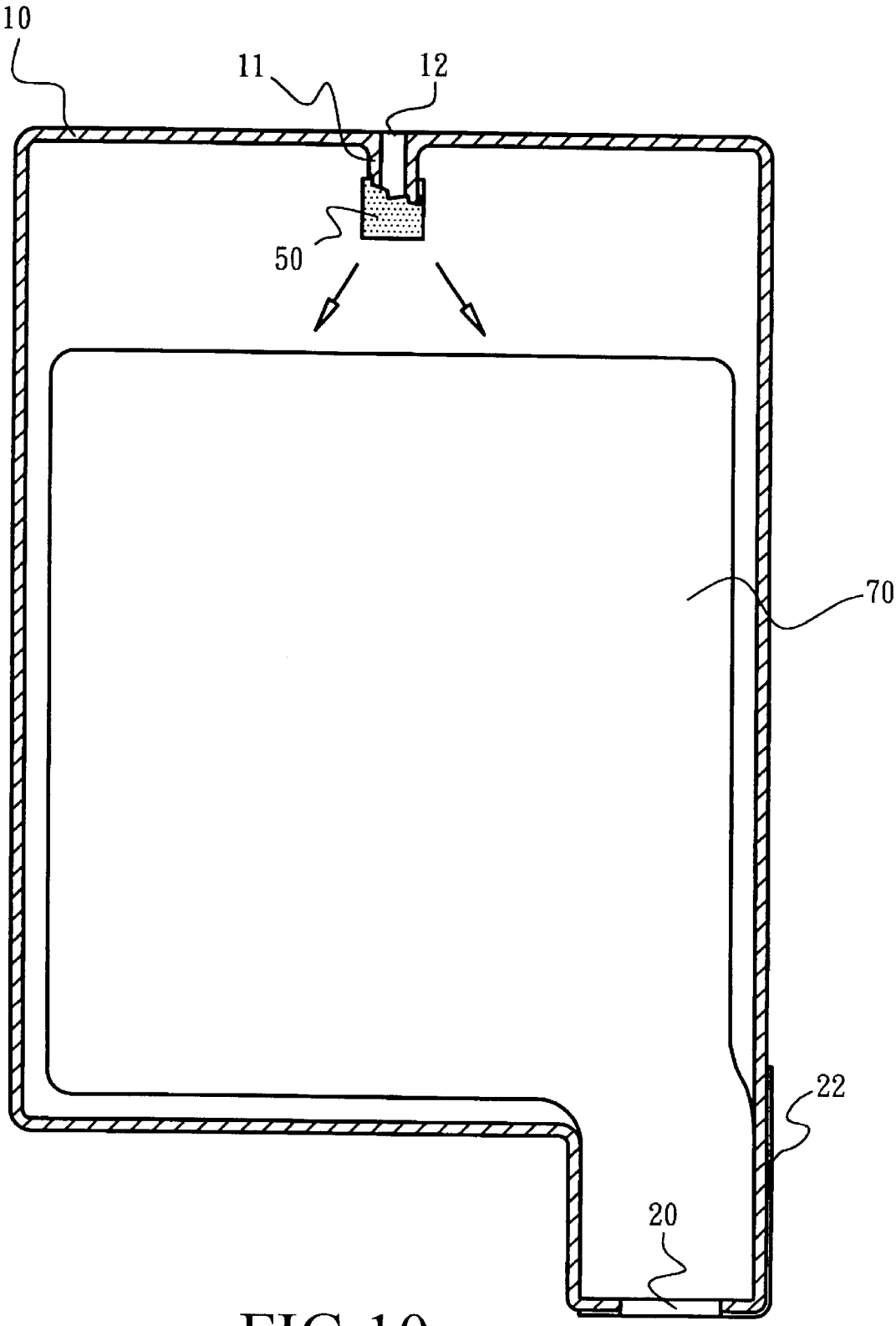
FIG. 10 illustrates the second application example having an ink bladder of the fourth embodiment of the invention.

A better way to apply the invention is shown in FIG. 10, wherein an ink bladder 70 is included such that the ambient air can flow into the ink cartridge 10 when the negative pressure is over the critical value. By isolating the ink bladder 70 the ambient air cannot directly contact with the ink 30.

The Third Application Example of the Fourth Embodiment

Figure 11:
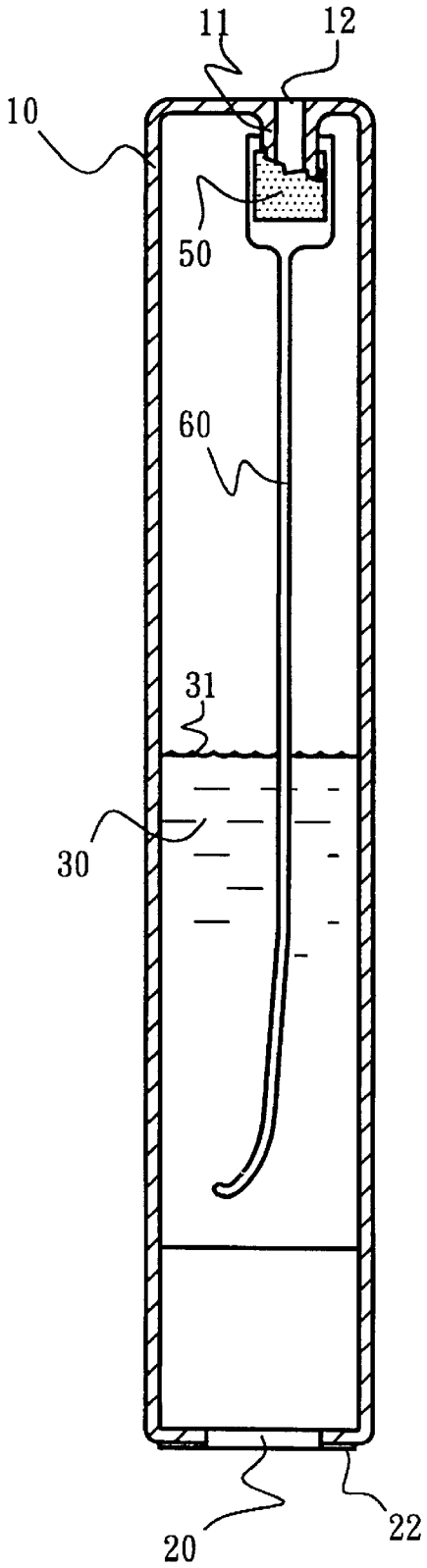
FIG. 11 illustrates the third application example of the fourth embodiment of the invention, wherein the gasbag is still flat before the negative pressure reaches a critical value.
Figure 12:
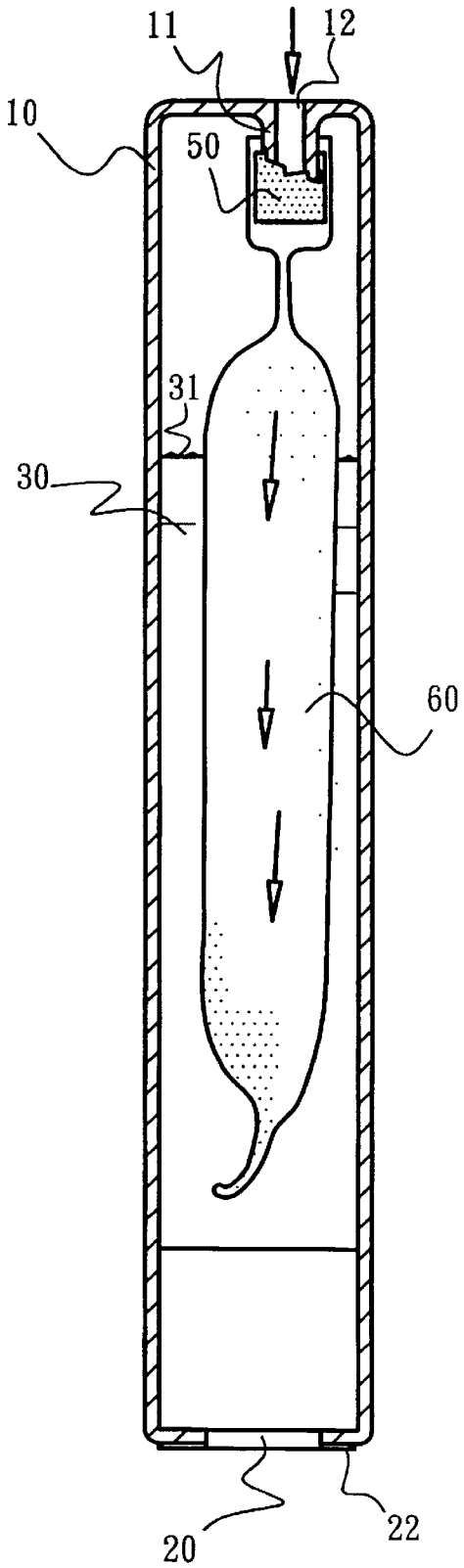
FIG. 12 illustrates the third application example of the fourth embodiment of the invention, wherein the free liquid surface level of ink inside the ink cartridge increases after the gasbag is refilled with air. The expanded gasbag occupies some volume of the ink cartridge.

Another way for the applications of the invention is shown in FIGS. 11 and 12, wherein a gasbag is utilized to enclose the fixed seat 11 so that the ambient air can flow into the gasbag 60 and make it expand when the negative pressure is over the critical value. By the expansion of the gasbag 60 the volume created by consuming the ink is automatically compensated to return the negative pressure to within a normal operating range. This method of applying the invention can also be applied to isolate the ambient air to be in direct contact with the ink 30 so that the ink 30 will not deteriorate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air pressure regulating device for ink cartridges mounted inside the ink cartridge of an ink pen comprising a printhead and an ink cartridge, wherein said ink cartridge having a ventilating vent on the one side, said air pressure regulating device comprises:

a fixed seat, having an annular trench settled on the surface of said fixed seat and a gas vent settled on the bottom of said annular trench to connect said ventilating vent of said ink cartridge; and an elastic gastight O-ring mounted on said annular trench to meet sealed requirements.

2. An air pressure regulating device for ink cartridges in accordance with claim 1, wherein said annular trench is an annular trench having a trapezial shape to guide said elastic gastight O-ring to the required position after settling.

3. An air pressure regulating device for ink cartridges in accordance with claim 1, wherein said annular trench has a second annular trench on its bottom and said second annular trench has a gas vent on its bottom to connect said ventilating vent of said ink cartridge.

4. An air pressure regulating device for ink cartridges in accordance with claim 1, wherein said annular trench has a concave trench on its bottom and said concave trench has a gas vent on its bottom to connect said ventilating vent.

5. An air pressure regulating device for ink cartridges in accordance with claim 1, wherein said elastic gastight O-ring induces the force by its elasticity, and said force which is utilized to meet sealed requirements is in equilibrium with the one induced by the atmospheric pressure when the pressure difference between the inside and outside regions of said ink cartridge is among 9–10 $cmH_2O$.

6. An air pressure regulating device for ink cartridges mounted inside the ink cartridge of an ink pen comprising a printhead and an ink cartridge, wherein said ink cartridge having a ventilating vent one the one side, said air pressure regulating device comprises:

a fixed seat, having a gas vent on the surface of said fixed seat to connect said ventilating vent of said ink cartridge; and an elastic gastight sleeve mounted on the surface of said fixed seat to meet sealed requirements.

7. An air pressure regulating device for ink cartridges in accordance with claim 6, wherein said fixed seat has an annular trench on its surface and said annular trench has a gas vent on its bottom to connect said ventilating vent.

8. An air pressure regulating device for ink cartridges in accordance with claim 6, wherein said fixed seat has a concave trench on its surface and said concave trench has a gas vent on its bottom to connect said ventilating vent.

9. An air pressure regulating device for ink cartridges in accordance with claim 6, wherein said elastic gastight sleeve induces the force by its elasticity, and said force which is utilized to meet sealed requirements is in equilibrium with the one induced by the atmospheric pressure when the pressure difference between the inside and outside regions of said ink cartridge is among 9–10 $cmH_2O$.

10. An air pressure regulating device for ink cartridges in accordance with claim 6, wherein said elastic gastight sleeve is an elastic rubber pipe.

11. An air pressure regulating device for ink cartridges in accordance with claim 6, wherein said fixed seat has a flange on its bottom and the upper part of said elastic gastight sleeve placed on said flange.

12. An air pressure regulating device for ink cartridges in accordance with claim 6, wherein said fixed seat has a concave ring on its bottom and the upper part of said elastic gastight sleeve placed on said concave ring.

13. An air pressure regulating device for ink cartridges in accordance with claim 6, wherein said fixed seat has a convex trench on its surface and said convex ring has a gas vent on its bottom to connect said ventilating vent.

14. An air pressure regulating device for ink cartridges in accordance with claim 6, wherein said elastic gastight sleeve is a plastic pipe.

15. An air pressure regulating device for ink cartridges mounted inside the ink cartridge of an ink pen comprising a printhead and an ink cartridge, wherein said ink cartridge having a ventilating vent on the one side, said air pressure regulating device comprises:

a fixed seat, having an annular trench on the surface of said fixed seat and said annular trench having a gas vent on the bottom to connect said ventilating vent of said ink cartridge;

a gasbag connects to said gas vent of said fixed seat to expand inside said ink cartridge while the ambient air refills said fixed seat; and an elastic gastight O-ring mounted on said annular trench to meet sealed requirements.

16. An air pressure regulating device for ink cartridges in accordance with claim 15, wherein said annular trench is an annular trench having a trapezial shape to guide said elastic gastight O-ring to the required position after settling.

17. An air pressure regulating device for ink cartridges in accordance with claim 15, wherein said annular trench has a second annular trench on its bottom and said second annular trench has a gas vent on its bottom to connect said ventilating vent of said ink cartridge.

18. An air pressure regulating device for ink cartridges in accordance with claim 15, wherein said annular trench has a concave trench on its bottom and said concave trench has a gas vent on its bottom to connect said ventilating vent.

19. An air pressure regulating device for ink cartridges in accordance with claim 15, wherein said elastic gastight O-ring induces the force by its elasticity, and said force which is utilized to meet sealed requirements is in equilibrium with the one induced by the atmospheric pressure when the pressure difference between the inside and outside regions of said ink cartridge is among 9–10 $cmH_2O$.

20. An air pressure regulating device for ink cartridges mounted inside the ink cartridge of an ink pen comprising a printhead and an ink cartridge, wherein said ink cartridge having a ventilating vent on the one side, said air pressure regulating device comprises:

a fixed seat, having a gas vent on the surface of said fixed seat to connect with said ventilating vent of said ink cartridge;

a gasbag connected to said gas vent of said fixed seat to expand inside said ink cartridge while the ambient air refills said fixed seat; and an elastic gastight sleeve mounted on the surface of said fixed seat to meet sealed requirements.

21. An air pressure regulating device for ink cartridges in accordance with claim 20, wherein said fixed seat has an annular trench on its surface and said annular trench has a gas vent on its bottom to connect said ventilating vent.

22. An air pressure regulating device for ink cartridges in accordance with claim 20, wherein said fixed seat has a concave trench on its surface and said concave trench has a gas vent on its bottom to connect said ventilating vent.

23. An air pressure regulating device for ink cartridges in accordance with claim 20, wherein said elastic gastight sleeve induces the force by its elasticity, and said force which is utilized to meet sealed requirements is in equilibrium with the one induced by the atmospheric pressure when the pressure difference between the inside and outside regions of said ink cartridge is among 9–10 $cmH_2O$.

24. An air pressure regulating device for ink cartridges in accordance with claim 20, wherein said elastic gastight sleeve is an elastic rubber pipe.

25. An air pressure regulating device for ink cartridges in accordance with claim 20, wherein said elastic gastight sleeve is a plastic pipe.

26. An air pressure regulating device for ink cartridges mounted inside the ink cartridge of an ink pen comprising a printhead and an ink cartridge, wherein said ink cartridge having a ventilating vent on the one side, said air pressure regulating device comprises:

a fixed seat, having a gas vent on the surface of said fixed seat to connect said ventilating vent of said ink cartridge;

an ink bladder containing ink and connects said printhead; and an elastic gastight sleeve mounted on the surface of said fixed seat to meet sealed requirements.

27. An air pressure regulating device for ink cartridges in accordance with claim 26, wherein said fixed seat has an annular trench on the surface and said annular trench has a gas vent on its bottom to connect said ventilating vent.

28. An air pressure regulating device for ink cartridges in accordance with claim 26, wherein said fixed seat has a concave trench on its surface and said concave trench has a gas vent on its bottom to connect said ventilating vent.

29. An air pressure regulating device for ink cartridges in accordance with claim 26, wherein said elastic gastight sleeve induces the force by its elasticity, and said force which is utilized to meet sealed requirements is in equilibrium with the one induced by the atmospheric pressure when the pressure difference between the inside and outside regions of said ink cartridge is among 9–10 $cmH_2O$.

30. An air pressure regulating device for ink cartridges in accordance with claim 26, wherein said elastic gastight sleeve is an elastic rubber pipe.

31. An air pressure regulating device for ink cartridges in accordance with claim 26, wherein said elastic gastight sleeve is a plastic pipe.

* * * * *